United States Patent [19]

Smolnik

[11] Patent Number: 4,771,696

[45] Date of Patent: Sep. 20, 1988

[54] BASE CLOSURE FOR THINWALL CARRIER PROJECTILE

[76] Inventor: John Smolnik, 81 Leamoor Dr., Parsippany, N.J. 07054

[21] Appl. No.: 50,417

[22] Filed: May 18, 1987

[51] Int. Cl.[4] ..... F42B 11/22

[52] U.S. Cl. ..... 102/473; 102/293; 102/357; 102/489; 102/517

[58] Field of Search ..... 102/293, 340, 342, 351, 102/357, 377, 489, 501, 473, 505, 517

[56] References Cited

U.S. PATENT DOCUMENTS

| | | | |
|---|---|---|---|
| 1,861,054 | 5/1932 | Hadfield | 102/517 |
| 4,124,318 | 11/1978 | Sagady | 403/359 |
| 4,348,956 | 9/1982 | Schmidlin | 102/377 |

*Primary Examiner*—Harold J. Tudor

[57] ABSTRACT

This disclosure relates to a large caliber, thinwall, cargo carrying, spin stabilized projectile of a type in which cargo is keyed to a projectile base member in order to preclude relative rotation between cargo and projectile during in-bore travel. In particular, the disclosure is directed toward an improved base closure method for the projectile including a method for transmitting in-bore torque through a base closure joint.

7 Claims, 2 Drawing Sheets

BASE CLOSURE FOR THINWALL CARRIER PROJECTILE

BACKGROUND OF THE INVENTION

Carrier projectiles, also termed carriers, typically include projectile-shaped bodies with an open aft end for receiving cargo, and a base closure for retaining cargo. The cargo is deployed by a time-fuzed ejection charge which severs a base closure joint to expel the cargo during projectile flight.

Current thickwall carrier designs join an engraving band to the wall of the projectile body. Cargo is keyed to the body wall as a means of fixing the cargo to the projectile. The design is reliable as it provides a straightforward in-bore torquing path from the banded body to the cargo via a mechanical interface.

A new thinwall carrier projectile concept arose from a desire to provide a cargo compartment capable of packaging a cargo of maximum feasible diameter within a given projectile caliber. The thinwall concept departs from that of thickwall carrier projectiles in that its cargo is keyed to a projectile base member, using a castellated interface or the like, rather than being keyed to a wall of a projectile body. This keying method, or constraint, presents design difficulties because the projectile base, in aggregate with its keyed cargo, is now a major inertial member of the projectile. Accordingly, both the projectile body and base require a substantial torquing means.

Candidate methods for accommodating the thinwall concept for its in-bore axial and angular acceleration environments include:

(1) An engraving band metallurgically bonded to a carrier body, a base keyed with an abutting cargo member, the base joined to the carrier body with threads, (2) An engraving band bonded to a base (instead of a carrier body), the base keyed to a cargo member, the base threaded to a carrier body.

In each case, an expelling charge is used to sever the threaded joint to permit expulsion of cargo. Therefore, joint design is cooperatively limited in retention strength.

In the first design, wherein the carrier body is banded, a friction interface between carrier body and base is relied upon to torque the base including its keyed cargo.

The second design, which uses a banded base, relies on an enhanced friction interface consisting of a knurled body face and knurled abutting base shoulder to torque the carrier body via the base.

Although both the above design arrangements may prove capable of withstanding in-bore and handling environments, there is a risk that neither will. In both methods, friction interfaces are required to transmit torque to major inertial members of the projectile. Since these friction interfaces do not provide a positive locking method, performance reliability is at risk.

The risk is greatest in worn tube firings. In one type of wear, tube rifling is worn severly at its origin. A gun-fired projectile thus accelerates freely before its band engages the tube rifling. Upon engagement of the band with the rifling, the projectile is subjected to a transiently high angular acceleration even before the band is fully engraved and while axial acceleration is low. Under these conditions effectiveness of friction interfaces are impaired relative to torque demands.

A third possible design approach is to employ a banded carrier body, a spline and groove interface between body and base, and a plurality of shear pins spaced along a circumference of the body and radially emplaced through the body and through the body-base interface. This method is capable of withstanding in-bore, rough handling, and transportation environments. However, the method is costly due to a great number of shear pins and matched holes needed for adequate base and cargo retention. In addition, where it is necessary to access cargo for reasons of surveillance, rework, or replacement of limited shelf life componentry, disassembly of the projectile closure is difficult.

PURPOSE OF THE INVENTION

The primary object of this invention is to provide an improved base closure means in combination with a means of transmitting in-bore torque to major projectile members for a thinwall, cargo carrying, spin stabilized projectile.

Another object of the invention is to provide a utile means of assembling a projectile base member and cargo within a carrier body.

Another object of the invention is to maximize available cargo length or, alternatively, maximize ogival length for a thinwall carrier projectile.

Other objects and advantages of the invention will become apparent from reading the following detailed description of the invention.

SUMMARY OF THE INVENTION

A base closure means and cooperative in-bore torquing mens is disclosed. The disclosure applies to a type of thinwall, cargo carrying, spin stabilized projectile in which cargo and base are keyed together such that relative rotation between the cargo and base is precluded.

The disclosed method includes an engraving band which is metallurgically bonded to an aft section of a thinwall projectile body, longitudinal grooves incised in an aft section of the body for receiving splines on a projectile base, threads which are incised in the body aft section and interrupted by the body grooves, a ring-like retainer which is threaded into the body threads and which shoulders on the base to retain the base, a collar member which is threaded to the base and abuts an aft face of the carrier body.

The method facilitates use of a spline interface between the carrier body and base, and thus provives a positive, mechanical, in-bore torquing means.

During assembly of cargo and base into the carrier body, the members are loaded into the body axially. Alignment of base splines with mating body grooves is necessary to complete insertion of the base into the body. The cargo and base are then secured by the screw-on ring retainer. Note that no turning of the base and its keyed cargo relative to the carrier body is required. In contrast, designs which employ a direct threaded interface between base and body require a minimum of two turns of base and cargo with respect to the carrier body during final closure operations, and frictional effects due to cargo turning adversely affect torquing consistency in assembly of the base closure.

An engraving band placement on the aft carrier body in lieu of band placement on the projectile base provides a dual advantage. Firstly, it permits the cargo-base interface to be located in a more rearward position with respect to the engraving band. This allows the projectile to contain a greater cylindrical cargo packaging length or, alternatively, a longer ogival form, under typical design constraints including projectile flight stability and maximum permissible overall projectile length. Secondly, the aft carrier body is a highly stressed section during in-bore axial acceleration owing to its thinwall construction and threaded joint incisions for attaching the projectile base. In locating the engraving band over the joint section, radial loads due to engraving band pressure tend to reduce the stress effects of high axial loading in this area.

Another embodiment of the invention provides a snap ring retainer means for retaining the base in lieu of a threaded ring retainer means.

BRIEF DESCRIPTION OF THE DRAWINGS

Reference is made to the following drawings wherein like reference characters designate corresponding parts in several views.

DETAILED DESCRIPTION OF THE DRAWINGS

Figure 1:
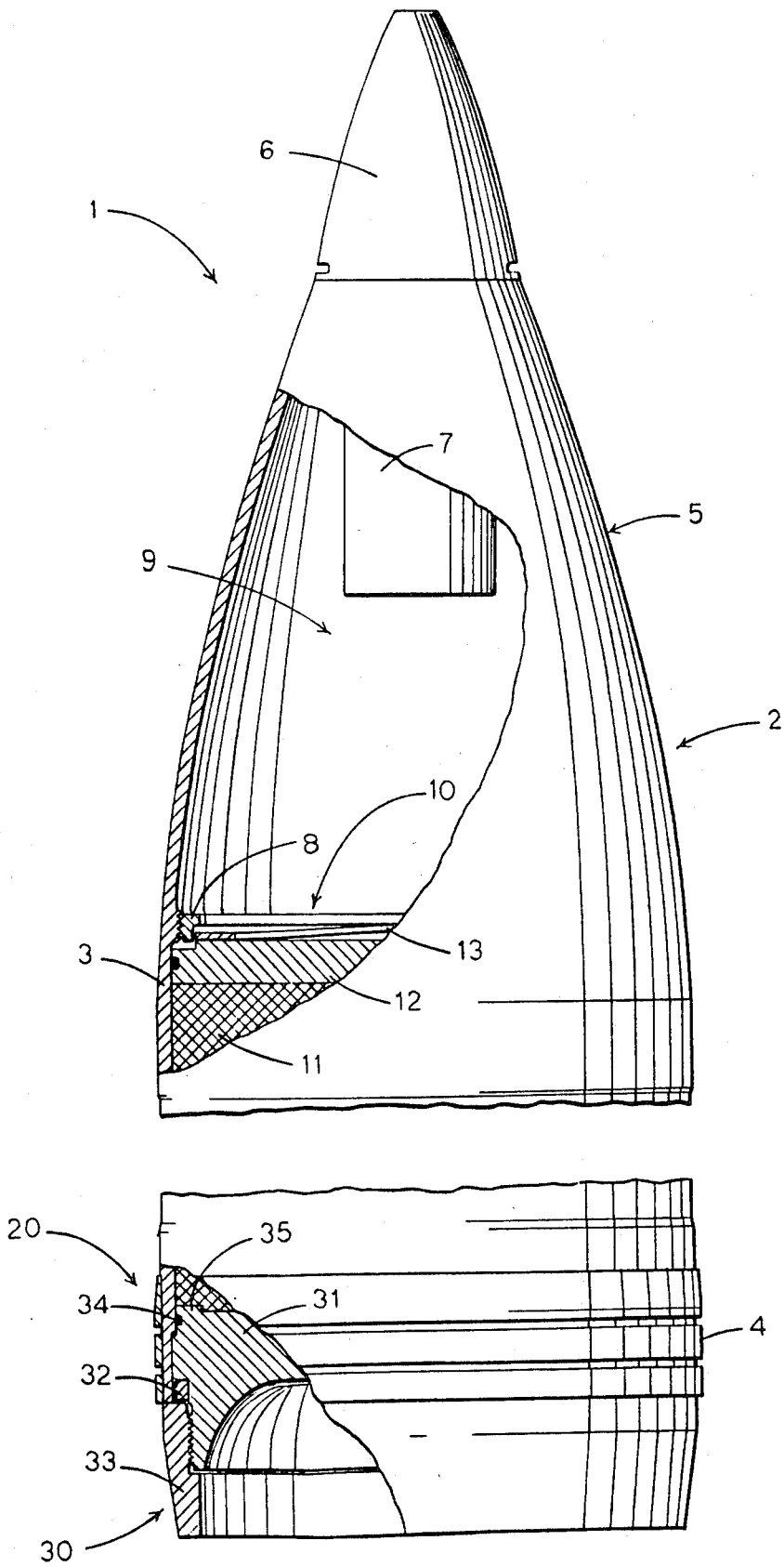
FIG. 1 is an overall view of a thinwall carrier projectile, a portion of an ogival section cut away to reveal inner members, and a partial axial sectional view of aft closure members including an embodiment of the present invention.

FIG. 1 illustrates a thinwall, cargo carrying, spin stabilized projectile, generally designated 1, of a type in which cargo and base are keyed together such that relative angular movement between cargo and base is precluded. Projectile 1 contains major assembly members which are broadly common to typical carrier projectiles including a body assembly 2, a cargo assembly 10 and a base closure assembly 30.

Body assembly 2 includes carrier body 3, ogive section 5, body aft section 20, engraving band 4 metallurgically bonded to body 3, time set fuze 6 with expelling charge 7 assembled to ogive section 5, optional take-up ring 8 to restrain cargo assembly 10, and expulsion chamber 9.

Cargo assembly 10 includes cargo 11, pusher plate 12 and wave washer 13. Cargo assembly 10 is slidably accommodated in a cylindrical cavity of body 3 via an open aft end of the body.

Base closure assembly 30 includes base 31, base retainer 32 and base collar 33. Base 31 includes a provision for accomodating o-ring 34 as a check against gas entry into a space surrounding cargo 11, and includes a provision for keying with an aft portion of cargo 11 in order to transmit in-bore torque therein. A plurality of projections 35 in form of a castellated interface with cargo 11 represents one possible cargo torquing means.

Figure 2:
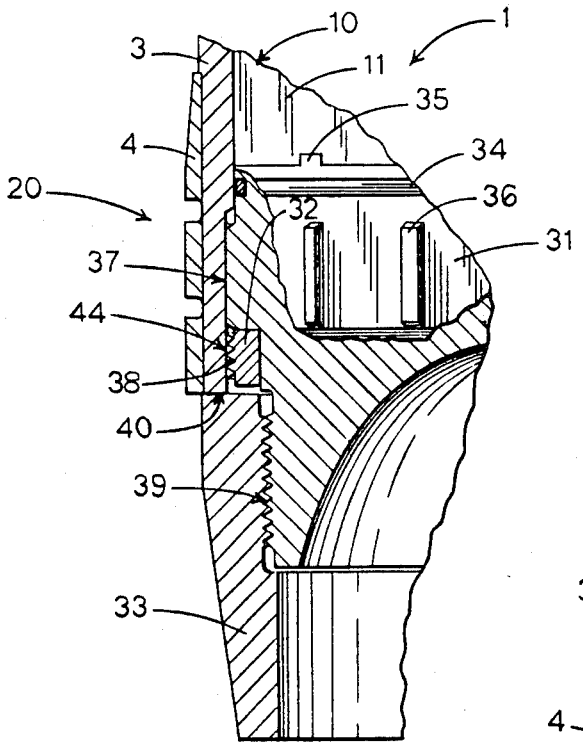
FIG. 2 is a partial axial sectional view of projectile aft members similar to FIG. 1 but enlarged for clarity to reveal additional details, and including a fragmentary elevation view of a projectile base.
Figure 3:
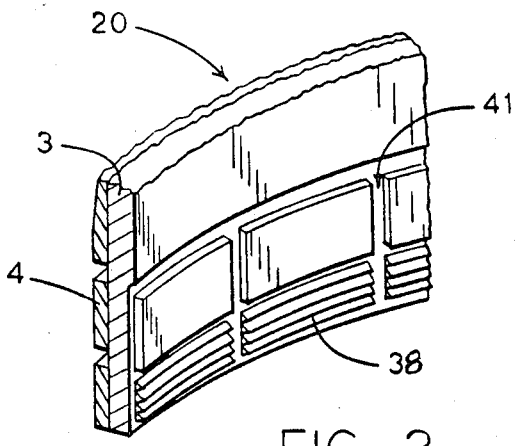
FIG. 3 is a perspective view of an inner section of an aft body portion of FIG. 2 configuration revealing retaining thread and groove incisions.

A sequence for assembly of projectile 1 is described by referring to FIGS. 2 and 3 which illustrate base closure means and torque transmission interfaces in greater clarity. Referring to FIG. 2, cargo assembly 10 and base 31 are inserted into body 3. Base splines 36 engage with body grooves 41 (FIG. 3) to form spline and groove interface 37. Base retainer 32 is threadingly joined to body threads 38 to secure base 31 and cargo assembly 10 within body 3. Assembly of base members is completed by threading collar 33 to base 31 via base threads 39 until knurled interface is engaged. Abutting surfaces which form interface 40 may include knurls impressed on a rear face of body 3 and knurls impressed on a forward face of collar 33.

Referring to FIG. 3, body threads 38 are interrupted by longitudinal grooves 41 which allow passage of splines 36 (FIG. 2) to their assembled position in a forward portion of grooves 41.

Other embodiments may feasibly include individual keys of generally rectangular cross-section to replace base splines 36, wherein base 31 would be modified to contain keyways in lieu of splines, wherein individual keys could be preassembled to the modified version of base 31, or alternatively inserted into matched keyways formed by assembly of the modified base to body 3, prior to threading body retainer 32 to body 3.

In-bore forces experienced by base joint members may be described by again referring to FIG. 2. Projectile 1 is chambered into a gun tube such that engraving band 4 is in proximate contact with an origin of rifling. Upon initiating a gun charge, projectile 1 is forced forward, causing gun rifling to engrave band 4. After band engraving is complete, a helical rifling path is followed as projectile 1 accelerates in the gun tube. Angular acceleration of projectile 1 becomes proportional to its axial acceleration under a uniform twist of rifling. Accompanying torque and axial loads must thus be accommodated in the structure of projectile 1.

Torque transmission from engraving band 4 to body 3 is achieved via a metallurgically bonded interface such as a welded copper overlay on body 3. Torque is transmitted to base 31 from body 3 via spline and groove interface 37. Base 31 torques cargo assembly 10 via an appropriate interface shown as projections 35 of a castellated interface. Collar 33 is torqued via friction interfaces at base threads 39 and interface 40. The interfaces thus described are capable of imparting torque to major projectile members even under worn tube conditions wherein a high initial angular acceleration may be experienced and wherein axial acceleration is relatively low.

A highly stressed body region, due primarily from axial loading, is aft body section 20. However, the effects of high axial loading in this area of body 3 are reduced by radially compressive loads derived from pressure transmitted by circumferentially emplaced band 4.

Base threads 39 must be of suitable integrity to withstand net in-bore axial loading which typically tends to push base 31 forward relative to collar 33.

Referring to FIG. 1, cargo expulsion is typically conducted near terminal projectile flight. Time fuze 6 is set for an appropriate time of flight after which expelling charge 7 is initiated. Pressure in chamber 9 acts on pusher plate 12. Force is translated to sever base closure joint 44, expelling cargo assembly 10 and base assembly 30. Cargo 11 then separates from other expelled members to continue its deployment.

Figure 4:
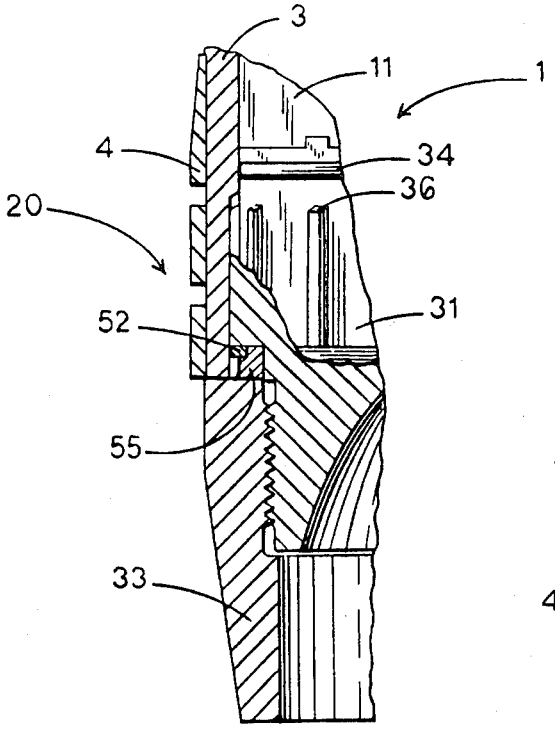
FIG. 4 is a partial axial sectional view of projectile closure members illustrating another embodiment of a base retaining means in accordance with the present invention.
Figure 5:
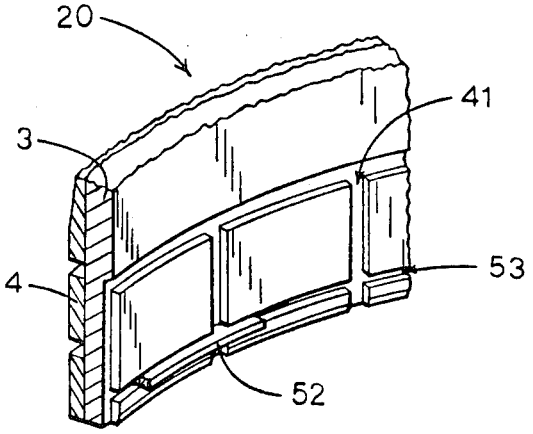
FIG. 5 is a perspective view of an inner section of an aft body portion of FIG. 4 configuration.

The same conditions exist in principle in the embodiment of FIG. 4. The difference is in a use of snap ring 52 and ring retainer 55 to replace threaded base retainer 32 of FIG. 2. Also, as illustrated in FIG. 5, body aft section 20 is modified to accommodate snap ring 52 with groove 53.

Referring again to FIG. 4, ring 52 is a severed ring capable of being compressed or expanded into a smaller or larger diametral dimension in order to permit assembly into groove 53. Ring retainer 55 radially arrests ring 52 in groove 53.

Although ring retainer 55 is illustrated as a discrete component, the retainer configuration may be included in a modified configuration of collar 33. Further, ring 52 could be replaced by a plurality of members, or segments, or it could consist of a ring having a plurality of members capable of being sprung or emplaced into a cooperative body groove.

Referring to FIG. 1, after completing base component assembly, use of optional take-up ring 8 is recommended to assure a tight cargo pack for this type of embodiment wherein a threaded base retainer is not utitlized. Where ogive and body members are not separable, as is the case illustrated in FIG. 1, access to take up ring 8 must be through a fuze well opening of ogive 5 using a suitably designed tool to rotate the take-up ring to tighten up cargo assembly 10.

Expulsion of cargo 11 similarly requires that base retaining members be severed by a pressure induced force of charge 7.

Various other modifications may be made in the disclosed method, detail, and construction without departing from the spirit and scope of the invention.

I claim:

1. A combination base closure and inbore torquing device for a cargo carrying spin stabilized projectile, said device comprising:

a body assembly including a body, an engraving band secured to an aft outside periphery of said body, said body including an interior cylindrical section, fully open at said body aft end, for receiving and accommodating cargo and a base, an aft portion of said body cylindrical section including longitudinal grooves;

a base closure assembly including said base, a ring, a base compartment collar, said base including longitudinal splines located on a periphery of said base for engaging said body longitudinal grooves, whereby relative rotation between said body and said base is precluded;

a base retaining means for axially retaining said base in said body including one or more circumferential grooves included in an aft part of said body cylindrical section aft portion, wherein said circumferential grooves cross said body longitudinal grooves, said ring including a circumferential groove engaging means for securing said ring to said body, said ring abutting said base to retain said base in said body, whereby a minimum force required to expel said cargo rearward is controlled by a severing strength of said base retaining means;

a threading means for joining said base collar with an aft section of said base wherein a forward face of said collar abuts a rear face of said body, whereby said body is supported by said collar and said base against relative axial movement rearward during inbore projectile acceleration.

2. The device of claim 1 wherein said body circumferential grooves are female threads of conventional helical form, wherein said circumferential groove engaging means are mating threads included in said ring.

3. The device of claim 1 wherein said circumferential groove engaging means is a snap ring means, wherein said ring is a snap ring which is positioned adjacent to said circumferential groove and flexibly expands into the groove.

4. The device of claim 3 further comprising:

a snap ring retaining means for positive lateral retention of said snap ring in said circumferential groove.

5. The device of claim 1 further comprising:

knurls on said body rear face, and knurls on said collar forward face, thereby providing an improved means for delivering torque from said body to said collar.

6. A combination base closure and inbore torquing device for a cargo carrying spin stabilized projectile, said device comprising:

a body assembly including a body, an engraving band secured to an aft outside periphery of said body, said body including an interior cylindrical section, fuflly open at said body aft end, for receiving and accommodating cargo and a base, an aft portion of said body cylindrical section including longitudinal grooves;

a base closure assembly including said base, a ring, a base compartment collar, said base including longitudinal splines located on a periphery of said base for engaging said body longitudinal grooves, whereby relative rotation between said body and said base is precluded;

a base retaining means for axially retaining said base in said body comprising female threads incised in an aft part of said body cylindrical section aft portion, wherein said threads cross said body longitudinal grooves, said ring including mating threads for securing said ring to said body, said ring abutting said base to retain said base in said body, whereby a minimum force required to expel said cargo rearward is controlled by a severing strength of said base retaining means;

a threading means for joining said base collar with an aft section of said base, wherein a forward face of said collar abuts a rear face of said body, whereby said body is supported by said collar and said base against relative axial movement rearward during inbore projectile acceleration.

7. The device of claim 6 further comprising:

knurls on said body rear face, and knurls on said collar forward face, thereby providing an improved means for delivering torque from said body to said collar.

* * * * *